United States Patent [19]

Belokin, Jr.

[11] 4,218,106

[45] Aug. 19, 1980

[54] BIFURCATED RESILIENT PIN-ENGAGING ELECTRICAL CONNECTOR AND METHOD FOR MAKING SAME

[76] Inventor: Paul Belokin, Jr., Rte. 4, Hayward, Wis. 54843

[21] Appl. No.: 956,911

[22] Filed: Nov. 2, 1978

[51] Int. Cl.[2] ..... H01R 11/02

[52] U.S. Cl. ..... 339/32 R; 339/50 R; 339/277 R

[58] Field of Search ..... 339/50 R, 257, 258 R, 339/258 P, 276 T, 277 R, 278 D, 31–33

[56] References Cited

U.S. PATENT DOCUMENTS

| | | | |
|---|---|---|---|
| 1,142,479 | 6/1915 | Beck | 339/257 |
| 1,703,325 | 2/1929 | Smarr | 339/257 |
| 1,845,273 | 2/1932 | Hosking | 339/277 R |
| 2,251,176 | 7/1941 | Temple, Jr. | 339/277 R |
| 2,758,947 | 8/1956 | Feighner | 339/278 D |
| 3,582,866 | 6/1971 | Johnson et al. | 339/50 R |
| 3,590,387 | 6/1971 | Landis | 339/257 |
| 3,905,013 | 9/1975 | Lee | 339/50 R |
| 3,989,335 | 11/1976 | Belokin, Jr. | 339/50 R |

FOREIGN PATENT DOCUMENTS

| | | | |
|---|---|---|---|
| 2609381 | 9/1976 | Fed. Rep. of Germany | 339/258 R |

*Primary Examiner*—Joseph H. McGlynn
*Attorney, Agent, or Firm*—James E. Nilles

[57] ABSTRACT

A flat thin electrical connector attached to the end of a wire and for releasable engagement with an electrically conductive cylindrical pin at the end of a fixture-mounted fluorescent tube comprises a resilient metal plate having coplanar prongs on opposite sides of a narrow-throated pin-receiving and engaging aperture which extends inwardly from an outer edge of the plate. The prong edges bordering the aperture make electrical contact with the pin. A slit extending from the aperture and between the prongs facilitates temporary displacement of the resilient prongs from their common plane in opposite directions to enable widening of the aperture throat sufficiently to accommodate pin passage. Insulating material covers the metal plate except for the prong edges bordering the aperture. Preferably, a smaller diameter pin-receiving aperture is provided inwardly of the slit for use with a relatively small diameter cylindrical pin.

A method of fabricating an electrical connector generally comprises the steps of: providing an electrically conductive plate; connecting an electrical conductor to the plate; covering both surfaces and the peripheral edge of said plate and a portion of said electrical connector adjacent said plate with electrical insulating material; and punching through said electrical insulating material and through said plate in a region remote from said conductor to provide pin-receiving apertures and an associated slit. Preferably, the coating is provided by dipping the plate in liquid plastic and subsequently drying the liquid plastic.

16 Claims, 10 Drawing Figures

BIFURCATED RESILIENT PIN-ENGAGING ELECTRICAL CONNECTOR AND METHOD FOR MAKING SAME

TECHNICAL FIELD

This invention relates generally to electrical connectors and, in particular, to those for use with electrically conductive pins at the ends of fixture-mounted fluorescent tubes and method for making same.

BACKGROUND OF THE PRIOR ART

U.S. Pat. Nos. 3,989,335 and 3,582,866, both owned by the assignee of the present application, disclose electrical connectors of the aforesaid character and wherein each connector comprises a flat thin metal plate covered with insulating material. These prior art connectors, which have one or more generally circular holes therethrough for accommodating the electrically conductive tube pins at the end of a fluorescent tube, require that one end of the tube be disconnected from the fixture when the connector is to be attached to or disconnected from the tube pins.

BRIEF SUMMARY OF THE INVENTION

A flat thin electrical connector attached to the end of a wire and for releasable engagement with an electrically conductive cylindrical pin at the end of a fixture-mounted fluorescent tube comprises a resilient metal plate having coplanar prongs on opposite sides of a narrow-throated pin-receiving and engaging aperture which extends inwardly from an outer edge of the plate. The prong edges bordering the aperture make electrical contact with the pin. A slit extending from the aperture and between the prongs facilitates temporary displacement of the resilient prongs from their common plane in opposite directions to enable widening of the aperture throat sufficiently to accommodate pin passage. Insulating material covers the metal plate except for the prong edges bordering the aperture. A small-diameter pin-receiving aperture is provided inwardly of the slit for use with a relatively small diameter cylindrical pin.

A method of fabricating an electrical connector generally comprises the steps of: providing an electrically conductive plate; connecting an electrical conductor to the plate; covering both surfaces and the peripheral edge of said plate and a portion of said electrical connector adjacent said plate with electrical insulating material; and punching through said electrical insulating material and through said plate in a region remote from said conductor to provide a pin-receiving aperture and an associated slit. Preferably, the coating is provided by dipping the plate in liquid plastic and subsequently drying the liquid plastic.

A connector in accordance with the invention has several advantages over the prior art. For example, a connector in accordance with the invention can be attached or detached from the fluorescent tube pin without removal of the tube pin from its associated fixture receptacle. Furthermore, although the bifurcated terminal, because of its flexibility and relatively movable bifurcated branches, can be easily connected or disconnected from the pin, it is positively connected to the tube pin when in place thereon. A connector in accordance with the invention is relatively simple in construction, economical to fabricate, easy to use, and well insulated against short-circuiting on the fixture and against shock hazard by the user. Other objects and advantages of the invention will hereinafter appear.

DESCRIPTION OF A PREFERRED EMBODIMENT

Figure 1:
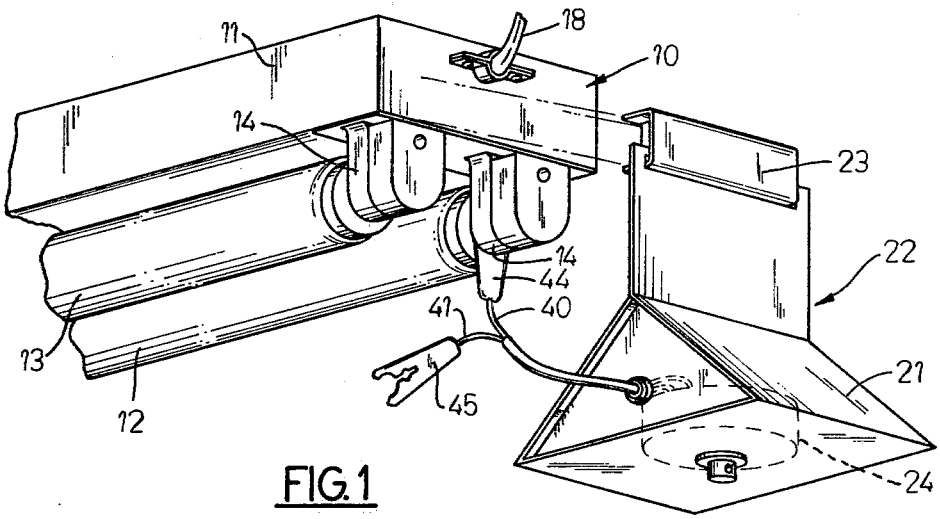
FIG. 1 is a perspective view of one end of a fluorescent light ceiling fixture on which a pair of fluorescent tubes are mounted and shows a power take-off unit having connectors in accordance with the present invention associated therewith.

Referring to FIG. 1, there is shown a ceiling-mounted fluorescent light fixture 10 which comprises a sheet metal housing 11 which is attached to the ceiling of a room, for example, and on which a pair of fluorescent lights or tubes 12 and 13 are mounted. Fixture 10 comprises a pair of adjacent fixture terminals 14 for one end thereof and each fixture terminal 14 has at least one electrically conductive pin receptacle 19 thereon. Each fluorescent tube 12, 13 has at least one electrically conductive pin 16 engaged with the pin receptacle 19 of its associated fixture terminal 14. Fixture 10 includes a cord 18 connecting it to an electrical power source.

Figure 3:
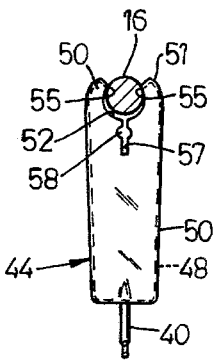
FIG. 3 is an end elevational view taken on line 3—3 of FIG. 2.
Figure 2:
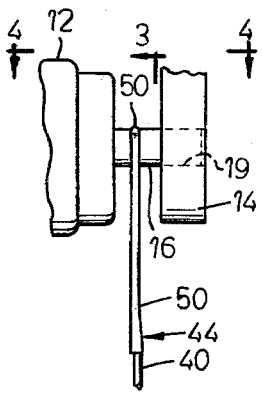
FIG. 2 is a side elevational view of one of the connectors of FIG. 1 and showing it connected to an associated fluorescent tube pin.

FIG. 1 also shows a power take-off unit 22 for use with fixture 10 and the tubes 12, 13 thereon. Power take-off unit 22 generally comprises a frame or housing 21 and means, such as a permanent magnet, 23 for supporting the power take-off unit near one end of the fixture 10 and a foreign electrical load, such as a small electric motor 24, which is supported in the housing 21. Means are provided in unit 22 for supplying electric power from the pin receptacles 19 of the pair of adjacent fixture terminals 14, through the pins 16 associated therewith, to the foreign load 24. Such means comprise a pair of electrical conductors 40 and 41, and a pair of connectors 44 and 45, respectively, connected to the conductors. As hereinafter explained in detail, the connectors 44 and 45 are identical to each other, and each comprises an electrically conductive plate 48 which is coated or covered with insulating material 50. Each electrical conductor 40, 41 has one end electrically connected or connectable to the load 24 and another end connected to the electrically conductive plate 48 of its associated connector 44, 45. FIGS. 1, 2, and 3 show connector 44 attached to pin 16 of tube 12. FIG. 1 also shows connector 45 detached from pin 16 of tube 13 with which it would normally be associated.

Figure 10:
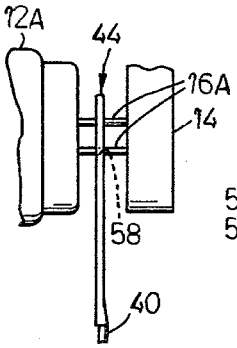
FIG. 10 is a view similar to FIG. 2 but showing one of the connectors associated with a fluorescent tube having a pair of relatively small-diameter pins at one end.
Figure 9:
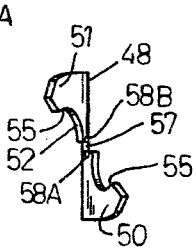
FIG. 9 is a top plan view taken on line 9—9 of FIG. 8.

FIGS. 1, 2, 3 and 4 show a fluorescent tube 12 having a single relatively large diameter pin 16 at one end thereof and such construction is typical of commercially available 8-foot long tubes. However, some 4-foot long commercially available tubes such as tube 12A shown in FIG. 10 employ two relatively small diameter pins 16A at one end thereof and a connector such as 44 is usable therewith, as FIG. 10 shows, and as hereinafter explained.

Since connectors 44 and 45 are identical to each other, only connector 44 is hereinafter described in detail. As FIGS. 1, 2, 3, 6, and 7 show, the flat thin bifurcated resilient insulated electrical connector 44 is attached to one end of electrical conductor 40 and is adapted for releasable edgewise engagement with the electrically conductive cylindrical pin 16 at one end of fixture-mounted fluorescent tube 12. Connector 44 comprises electrically conductive flat thin bifurcated resilient metal plate 48 to which conductor wire 40 is attached and the plate has coplanar flat prongs 50 and 51 disposed on opposite sides of a narrow-throated pin-receiving and pin-engaging aperture 52 which extends inwardly from an outer edge 53 of the plate. The prong edges 55 bordering the pin-receiving aperture 52 make electrical contact with the outside of the pin 16. A slit or slot 57 extending from the aperture 52 and between the prongs 50 and 51 in a direction away from and transverse to the outer edge 53 of the plate 48 facilitates temporary displacement of the resilient prongs 50 and 51 in opposite directions from their common plane P (see FIG. 7) to enable widening of the aperture throat 54 for accommodating pin passage (see FIGS. 4, 5, 8, and 9). Flexible insulating material 50, shown in FIGS. 1–5, coats or covers the metal plate 48 except for the prong edges 55 bordering the aperture 52.

Figure 6:
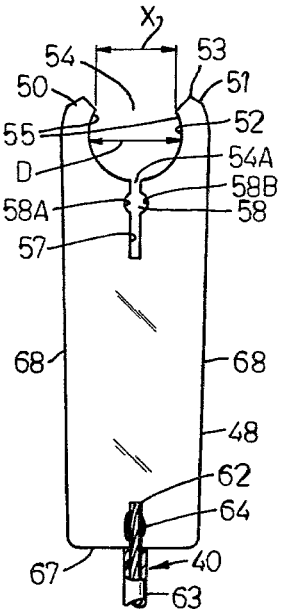
FIG. 6 is an enlarged plan view of the connector shown in FIGS. 1, 2, and 3 but with the insulating material removed so as to illustrate structural details of the metal plate therewithin.
Figure 7:
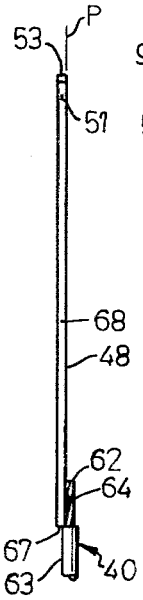
FIG. 7 is a side elevational view of the metal plate shown in FIG. 6.
Figure 8:
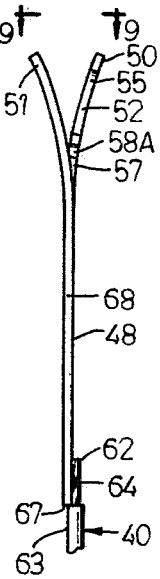
FIG. 8 is a view similar to FIG. 7 but showing the bifurcated branches displaced relative to each other.

As FIGS. 2, 6, and 7 best show, electrical conductor 40 takes the form of a flexible wire comprising an electrically conductive twisted wire 62 and a covering of insulation 63. Wire 62 of conductor 40 has one end electrically and mechanically connected, as by soldering at 64, to an end of metal plate 48 of connector 44.

Metal plate 48, which is preferably fabricated of resilient copper or bronze, for example, has the forward edge 53, hereinbefore referred to, a rear edge 67 and spaced apart side edges 68. Metal plate 48 is provided with the pin-receiving aperture or hole 52 which extends inwardly from forward edge 53 and the slit or slot 57 extending from aperture 52 in a direction away from forward edge 53 toward rear edge 67. Aperture 52 and slot 57 cooperate to cause plate 48 to take the form of a bifurcated plate having the two branches, forks, blades, or legs 50 and 51 which are temporarily displaceable relative to each other from the common plane P (see FIGS. 2 and 9) in which they normally lie (compare FIG. 2 with FIGS. 4 and 5 and compare FIG. 7 with FIGS. 8 and 9). The slot 57 enables substantially greater relative displacement of the blades 50 and 51 without permanent deformation of plate 48 than would be possible if only aperture 52 were provided.

Figure 5:
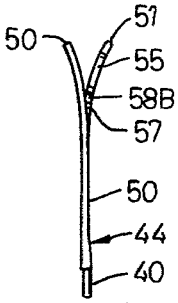
FIG. 5 is a side elevational view taken on line 5—5 of FIG. 4.
Figure 4:
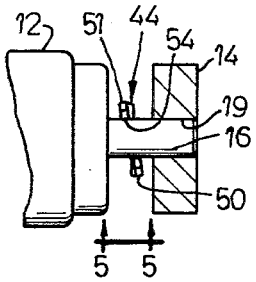
FIG. 4 is a view taken on line 4—4 of FIG. 2 showing the bifurcated connector with its branches or legs displaced, as during connection or disconnection from the tube pin.

As FIGS. 3 and 6 best show, aperture 52 has a shape generally similar to that of the cross-sectional configuration of tube pin 16 but is slightly larger. In the embodiment disclosed, pin 16 is of circular cross section and aperture 52 is also generally circular and has a slightly larger diameter than pin 16. However, other pin and aperture shapes are possible. As FIG. 6 shows, aperture 52 has a diameter designated D which is greater than the dimension X of the throat 54. As a result, pin 16 cannot be directly inserted through throat 54 into aperture 52 unless the connector 44 is manipulated as shown in FIGS. 4 and 5 to cause the distance across the throat 54 to be increased to a dimension greater than diameter D of pin 16. However, when the pin 16 is inserted in aperture 52, the pin is mechanically secured therewithin and cannot be removed therefrom unless the prongs 50 and 51 are displaced (see FIGS. 4 and 5). As FIG. 3 makes clear, the edges 55 of the prongs 50 and 51 of metal plate 48 make electrical contact with points on the circumference of pin 16.

The flexible insulating material 50 shown in FIGS. 1–5 preferably takes the form of a plastic coating which is applied to the plate and wire assembly shown in FIG. 6, which coating is applied in such a manner as to leave the edges 55 of aperture 52 exposed or bare so that electrical contact between such edges and pin 16 is possible during use of the connector. However, it is possible, as a practical matter, to fabricate connector 44 in the following manner. A metal blank having an outline similar to the plate 48 shown in FIG. 6, but without the throat 54, aperture 52, or slit 57 provided therein, is stamped from a sheet of metal. The wire 62 is soldered thereto as shown in FIG. 6. The entire assembly is then dipped in a plastic coating which is allowed to dry. After drying, the coated metal plate is inserted in a stamping or blanking press and the throat 54, the aperture 52, and the slot 57 are then simultaneously punched to provide the structure shown in FIG. 3. The advantage of the aforedescribed method of construction is that all outer edges of the member 48, such as the edges 53, 67, and 68, are coated with insulating material, whereas the edges along the throat 54, the aperture 52, and the slit 57 are insulation free.

If preferred, the insulating material 50 could take the form of insulating sheet material applied to opposite surfaces of the plate 48 and heat sealed thereto and along the peripheral edges. Furthermore, instead of dip coating in plastic, the plastic insulating material could be sprayed or painted onto the metal plate 48 leaving the edges along the throat 54, the aperture 52, and the slit 57 insulation free.

As FIGS. 3 and 6 best show, connector 44 and plate 48 thereof are further provided with a relatively small pin-receiving aperture 58 which is defined by semi-circular indentations 58A and 58B extending inwardly from slot 57 into the blades or prongs 50 and 51. Aperture 58, which is located inwardly of the larger aperture 52 and is adapted to accommodate a small-diameter pin 16A of fluorescent tube 12A as shown in FIG. 10 when connector 44 is used with such a tube, instead of the type of tube shown in FIGS. 2, 3, and 4. Slot 57 facilitates planar displacement of the prongs 50 and 51 when the throat 54A of aperture 58 needs to be widened to accommodate pin 16A during connection or disconnection of the connector 44. The prong edges adjacent aperture 58 are insulation free.

I claim:

1. In combination:

a fluorescent light fixture having a fixture terminal thereon which includes an electrically conductive pin receptacle therein;

a fluorescent tube mounted on said fixture and having an electrically conductive pin at one end thereon engaged with said pin receptacle;

said one end of said tube and said fixture terminal defining a space therebetween;

and an electrical connector for insertion into said space for releasable engagement with said electrically conductive pin and for attachment to the end of an electrical conductor, said connector comprising:

an electrically conductive resilient metal plate including two coplanar oppositely displaceable prongs on opposite sides of a pin-receiving aperture which has a narrow throat communicating with an outer edge of said plate, the edges of said prongs confronting said aperture being adapted to make electrical contact with said pin disposed in said aperture;

said plate further including a slit extending from said aperture on a side opposite said throat to facilitate displacement of said prongs from their common plane to enable enlargement of said throat to accommodate passage of said pin therethrough;

an electrical insulating material on said plate but disposed so as to leave said prong edges uninsulated.

2. A combination according to claim 1 wherein said pin has a circular cross section and wherein said pin-receiving aperture is complementary in shape to said circular cross section, with said throat of said aperture being narrower than the diameter of said pin when said prongs are coplanar.

3. A combination according to claim 1 wherein said electrical insulating material comprises a plastic coating.

4. A combination according to claim 3 wherein said plastic coating covers both surfaces of said plate and the outer edge of said plate.

5. In combination:

a fluorescent light fixture having a fixture terminal thereon which includes an electrically conductive pin receptacle therein;

a fluorescent tube mounted on said fixture and having an electrically conductive pin at one end thereon engaged with said pin receptacle;

said one end of said tube and said fixture terminal defining a space therebetween;

and an electrical connector for inserting into said space for releasable engagement with said electrically conductive pin and for attachment to the end of electrical conductor, said connector comprising:

an electrically conductive resilient metal plate having an outer edge and including two coplanar oppositely displaceable prongs on opposite sides of a pin-receiving aperture having a narrow throat and extending inwardly from said outer edge, the inner edges of said prongs confronting said aperture being adapted to make electrical contact with said pin disposed in said aperture, said pin-receiving aperture being complementary in shape to cross-sectional configuration of said pin, with the throat of said aperture being narrower than the diameter of said pin when said prongs are coplanar;

said plate further including a slit extending from said aperture on a side opposite said throat to facilitate displacement of said prongs from their common plane to enable enlargement of said throat to accommodate passage of said pin therethrough;

and electrical insulating material on said plate but disposed so as to leave said inner edges of said prongs uninsulated, said electrical insulating material comprising a plastic coating which covers both surfaces of said plate and said outer edge of said plate.

6. In combination:

a fluorescent light fixture having a fixture terminal thereon which includes an electrically conductive pin receptable therein;

a fluorescent tube mounted on said fixture and having an electrically conductive pin at one end thereon engaged with said pin receptacle;

said one end of said tube and said fixture terminal defining a space therebetween;

and an electrical connector for insertion into said space for releasable engagement with said electrically conductive pin and for attachment to the end of an electrical conductor, said connector comprising:

an electrically conductive resilient metal plate including two coplanar oppositely displaceable prongs on opposite sides of a pair of pin-receiving apertures, said apertures being of different size and each having a narrow throat, whereby the prong edges confronting said apertures are adapted to make electrical contact with said pin disposed in either of said apertures, depending on the diameter of said pin;

said plate including one narrow throat extending from an outer edge thereof to one of said apertures; said plate further including a first slit extending between said apertures and a second slit extending from the innermost aperture to facilitate displacement of said prongs from their common plane to enable enlargement of said throats to accommodate passage of a pin therethrough;

and electrical insulating material on said plate but disposed so as to leave said prong edges uninsulated.

7. A combination according to claim 6 wherein said pin has a circular cross section and wherein respective pin-receiving apertures are complementary in shape to said circular cross section, with the throat of each of said apertures being narrower than the diameter of a pin for association therewith when said prongs are coplanar.

8. A combination according to claim 6 wherein said electrical insulating material comprises a plastic coating.

9. A combination according to claim 8 wherein said plastic coating covers both surfaces of said plate and the outer edge of said plate.

10. In combination:

a fluorescent light fixture having a fixture terminal thereon which includes an electrically conductive pin receptacle therein;

a fluorescent tube mounted on said fixture and having an electrically conductive pin at one end thereon engaged with said pin receptacle;

said one end of said tube and said fixture terminal defining a space therebetween;

and an electrical connector for insertion into said space for releasable engagement with said electrically conductive pin and for attachment to the end of an electrical conductor, said connector comprising:

an electrically conductive resilient metal plate having an outer edge and including two coplanar oppositely displaceable prongs on opposite sides of a pair of narrow-throated pin-receiving apertures located inwardly from said outer edge, said apertures being of different diameters, whereby the inner prong edges confronting said apertures are adapted to make electrical contact with a pin of appropriate size disposed in either of said apertures, said pin-receiving apertures being complementary in shape to the cross-sectional configuration of pins to be associated therewith, with the throat of each of said apertures being narrower than the diameter of a pin for association therewith when said prongs are coplanar;

said plate further including a first slit extending between said apertures and a second slit extending from the innermost aperture to facilitate displacement of said prongs from their common plane to enable enlargement of an aperture throat to accommodate passage of a respective pin therethrough;

and electrical insulating material on said plate but disposed so as to leave said inner prong edges uninsulated, said electrical insulating material comprising a plastic coating which covers both surfaces of said plate and said outer edge of said plate.

11. A combination according to claim 10 wherein said pin has a circular cross section and wherein a pin-receiving aperture is complementary in shape to said circular cross section, with the throat of an aperture being narrower than the diameter of a pin for association therewith when said prongs are coplanar.

12. A combination according to claim 10 wherein said electrical insulating material comprises a plastic coating.

13. A combination according to claim 12 wherein said plastic coating covers both surfaces of said plate and the outer edge of said plate.

14. In combination:

a fluorescent light fixture having a fixture terminal thereon which includes an electrically conductive pin receptacle therein;

a fluorescent tube mounted on said fixture and having an electrically conductive pin at one end thereon engaged with said pin receptacle;

said one end of said tube and said fixture terminal defining a space therebetween;

and a take-off unit energizable from said fluorescent tube fixture and including a connector which is insertable into said space and releasably attachable to said electrically conductive pin at said end of said fluorescent tube, said connector comprising:

an electrically conductive flat thin resilient metal plate covered on both surfaces with insulating material and having a pin-receiving aperture extending inwardly from an edge thereof to provide a bifurcated member having two oppositely displaceable prongs, said aperture having a shape generally similar to that of the tube pin cross-sectional configuration and having a throat near said edge which is narrower than the diameter of said tube pin;

said connector further comprising a slit extending inwardly from said aperture in a direction away from said edge to allow said prongs to be displaced relative to each other to enlarge said throat thereby enabling said connector to be attached or detached from the tube pin.

15. A method of releasably attaching an electrical connector to an electrically conductive pin located at the end of a fluorescent tube and engaged with an electrically conductive pin receptacle on a fixture terminal on a fluorescent light fixture, there being a space between the end of said fluorescent tube and said fixture terminal, comprising the steps of:

providing a connector in the form of an electrically conductive resilient metal plate having two coplanar oppositely displaceable prongs on opposite sides of a pin-receiving aperture, which aperture is provided with a narrow throat communicating with an outer edge of said plate and with a slit extending from said aperture on a side thereof opposite said throat;

inserting said connector into said space and against said pin so that the plane in which said connector lies is transverse to the axis of said pin; and pushing said connector toward and against said pin with a twisting motion so as to cause said prongs to be displaced in opposite directions from each other and thereby cause said narrow throat to enlarge sufficiently to accommodate passage of said pin therethrough into said pin-receiving aperture for electrical contact with the edge of said aperture, whereupon said prongs resume their coplanar relationship.

16. A method according to claim 15 for releasing said connector from said pin including the further step of pulling said connector away from and pin with a twisting motion so as to cause said prongs to be displaced in opposite directions from each other and thereby cause said narrow throat to enlarge sufficiently to accommodate passage of said pin therethrough out of said pin-receiving aperture whereupon said prongs resume their coplanar relationship.

* * * * *